United States Patent [19]

Preissinger et al.

[11] Patent Number: 4,744,138

[45] Date of Patent: May 17, 1988

[54] METHOD OF MANUFACTURING A HIGH-VOLTAGE CURRENT TRANSFORMER

[75] Inventors: Norbert Preissinger, Litzendorf; Teofil Bogdan, Bamberg, both of Fed. Rep. of Germany

[73] Assignee: MWB Messwandler-Bau Aktiengesellschaft, Bamberg, Fed. Rep. of Germany

[21] Appl. No.: 83,825

[22] Filed: Aug. 11, 1987

Related U.S. Application Data

[63] Continuation of Ser. No. 929,513, Nov. 12, 1986, Pat. No. 4,701,738.

[30] Foreign Application Priority Data

Nov. 15, 1985 [DE] Fed. Rep. of Germany ..... 3540547
Mar. 13, 1986 [DE] Fed. Rep. of Germany ..... 3608391

[51] Int. Cl.[4] ..... H01F 7/06
[52] U.S. Cl. ..... 29/606; 29/602 R
[58] Field of Search ..... 29/602 R, 606; 336/90, 336/92, 94, 96, 107, 173–175, 192

[56] References Cited

U.S. PATENT DOCUMENTS 3,380,009 4/1968 Miller .
4,117,437 9/1978 Ottesen .

FOREIGN PATENT DOCUMENTS 0774638 5/1957 United Kingdom .

*Primary Examiner*—Carl E. Hall
*Attorney, Agent, or Firm*—Barnes & Thornburg

[57] ABSTRACT

A high-voltage current transformer of the head design with a column made of insulating material which supports the head housing. The primary lead is approximately U-shaped, whereby only its horizontal base passes through the central opening of secondary system and at least one of its two legs passes downwardly through a sealing plate in an insulating-medium-tight fashion to outside the space delimited by insulating column, and is contactable from below. The other of the two legs passes through sealing plate in the case of a switchable primary lead likewise downward in an insulating-medium-tight fashion and is directly contactable or in the case of a non-switchable primary is electrically connected to the sealing plate without any holes therethrough. The head housing, designed as hood, also completely encloses primary lead and secondary system from above and is fastened in an insulating-medium-tight fashion to sealing plate.

1 Claim, 10 Drawing Sheets

METHOD OF MANUFACTURING A HIGH-VOLTAGE CURRENT TRANSFORMER

This is a divisional of application Ser. No. 929,513, filed Nov. 12, 1986, now U.S. Pat. No. 4,701,738.

BACKGROUND AND SUMMARY OF THE INVENTION

The present invention relates to a high-voltage current transformer of the head design having an insulative material column supporting a head housing and to a method of manufacturing such a high-voltage current transformer.

A high-voltage current transformer of this type is known from German No. A-16 13 798. This high-voltage current transformer provides a sealing plate on a column made of insulating material. A cylindrical head hood assemblable from two flanged parts is mounted laterally on the plate. The hood-shaped upper part of the head hood is provided with two side openings through which, in the usual fashion, the rod-shaped primary leads are fed. An electrical contact is made at an opening between the primary lead and the hood, while the primary lead is insulated where it is fed through the other opening. The rod-shaped primary lead passes through the annular core or cores of the secondary system in the horizontal direction. The annular cores of the secondary system are enclosed in a metallic grounded core capsule. The core capsule is then mounted along with the annular cores by a conical insulator on the sealing plate of the insulating column and supported therewith. The head hood is divided transversely for assembly reasons and is therefore designed in the form of two shells.

In addition, a high-voltage current transformer is known from German No. A-27 28 191 in which a sealing plate is provided on a column made of insulating material, on which plate a cylindrical head hood, in a lying position, is welded to the sealing plate and is connected to a lateral outlet opening, located beneath via a molded shaft. The primary lead is fed through the standing annular cores of the secondary system parallel to the horizontal lengthwise axis of the head hood and is brought in or out at the ends of the head hood each provided with an opening. The annular cores of the secondary system are enclosed in a metallic grounded core capsule. The core capsule is supported either on the ends of the head hood and/or on the lead tube for the secondary leads, which passes through the insulating column. For improved installation, the head hood is divided lengthwise and thus made in the form of two shells.

Both known designs of a high-voltage current transformer with a head hood therefore have not only three openings which must be tightly sealed during assembly for subsequent filling with insulating fluid or an insulating gas under pressure, but also have the transverse or lengthwise separating planes of the head housing which remain to be sealed.

The goal of the present invention is to design a high-voltage current transformer that permits simple manufacture of the head housing and a good seal with the smallest possible number of feedthroughs or separating planes to be sealed within the head housing or sealing plate. At the same time, the primary leads and secondary system must be capable of being mounted simply on the sealing plate of the insulating column.

This goal is achieved by mounting a secondary system having an annulus coil to a sealing plate and mounting a U-shaped primary lead having a horizontal base passing through the center opening of the secondary coil and having two legs mounted to the sealing plate. At least one of the legs of the primary lead passes through the sealing plate in an insulating-medium tight fashion to outside the space delineated by an insulating column, to which the sealing plate is mounted such that electrical contact can be made to the leg below the sealing plate. Electrical contact to the other leg may be made via the conductive sealing plate or it also may extend through the sealing plate in an insulating-medium tight fashion to outside the sealing plate where electrical contact may be made directly. The only other opening in the sealing plate is where the lead for the secondary system extends therethrough into the insulating column. A lead tube in the insulating column may be connected in a plug-in manner to the secondary lead of the secondary system. A hood is secured to the sealing plate and encompasses the secondary system and the primary leads therebetween. Other than a minimum of two and a maximum of three openings in the sealing plate, there are no other openings in the system and no openings in the hood.

The method of assembly is securing the secondary system to the sealing plate, inserting the U-shaped primary lead through the opening in the secondary system and securing it to the sealing plate, mounting the sealing plate to the insulative material column and securing the hood to the sealing plate either before securing the sealing plate to the insulative column or thereafter.

The secondary system is mounted to the sealing ring by insulative supports which engages at one end support surfaces on the sealing plate which are perpendicular to the longitudinal axis of the support. The supports are either secured internal to the sealing plate interior the hood, or using external screws which are covered by tight caps. The U-shaped primary lead may be composed of three elements being a base and two legs or of two elements being an angle and a single leg. The primary lead may be a single non-switchable lead or may be a dual-switchable lead formed from two concentric leads being switchable between separate, series or parallel connections. The legs may be flattened and displaced from the center axis of the fastener.

In the design for a high-voltage current transformer of the head design according to the invention, all the lateral openings in the head hood are eliminated and the head hood is completely relieved of the weight of the secondary system. Therefore, the head hood can be made of much thinner material, possibly even in one piece in a deep drawing process, and can thus be made much less expensively and lighter. The design of the high-voltage head current transformer according to the invention also permits all parts to be preassembled on the sealing plate and the unit thus preassembled can be mounted on the insulating column and fastened there. In addition, a controlled film feedthrough in the through opening of the secondary system, like that which is frequently conventional, can be eliminated. Therefore, a homogeneous insulating medium, especially an inert insulating gas such as sulfur hexafluoride or insulating oil can be used.

Other objects, advantages and novel features of the present invention will become apparent from the following detailed description of the invention when considered in conjunction with the accompanying drawings.

DETAILED DESCRIPTION OF THE DRAWINGS

Figure 1:
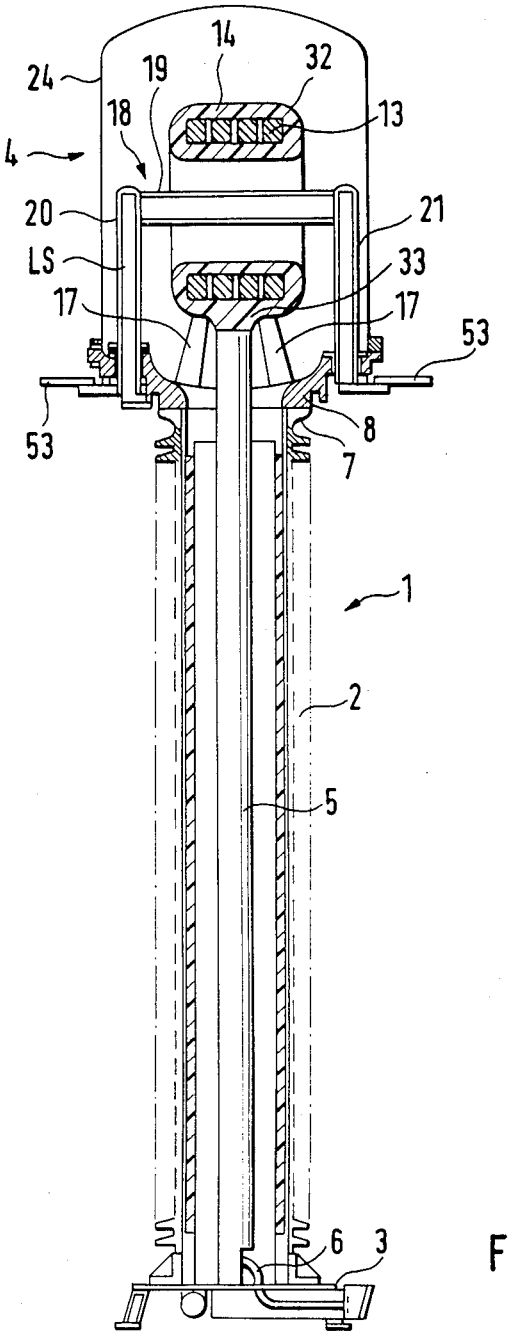
FIG. 1 is a side view in cross section of a high-voltage current transformer of the head design.

A high-voltage current transformer 1 of the head design, being pressurized, in the conventional manner, with an inert insulating gas, such as sulfur hexafluoride as illustrated in FIG. 1. The converter 1 essentially consists of a column 2 made of insulating material, such as porcelain or epoxy resin or a compound insulator made of a fiberglass-reinforced plastic tube with cast silicone ribs, of a base 3 supporting the column 2, and a head part 4 containing the active system composed of the primary lead 18 and the secondary system 16. A lead tube 5 is disposed coaxially in column 2. Secondary leads 6 run and are guided to the secondary terminals in base 3 through tube 5. A potential control device, especially a potential control winding consisting of insulating foil and capacitor assemblies, can be provided between lead tube 5 and column 2 in a well known manner.

Figure 2:
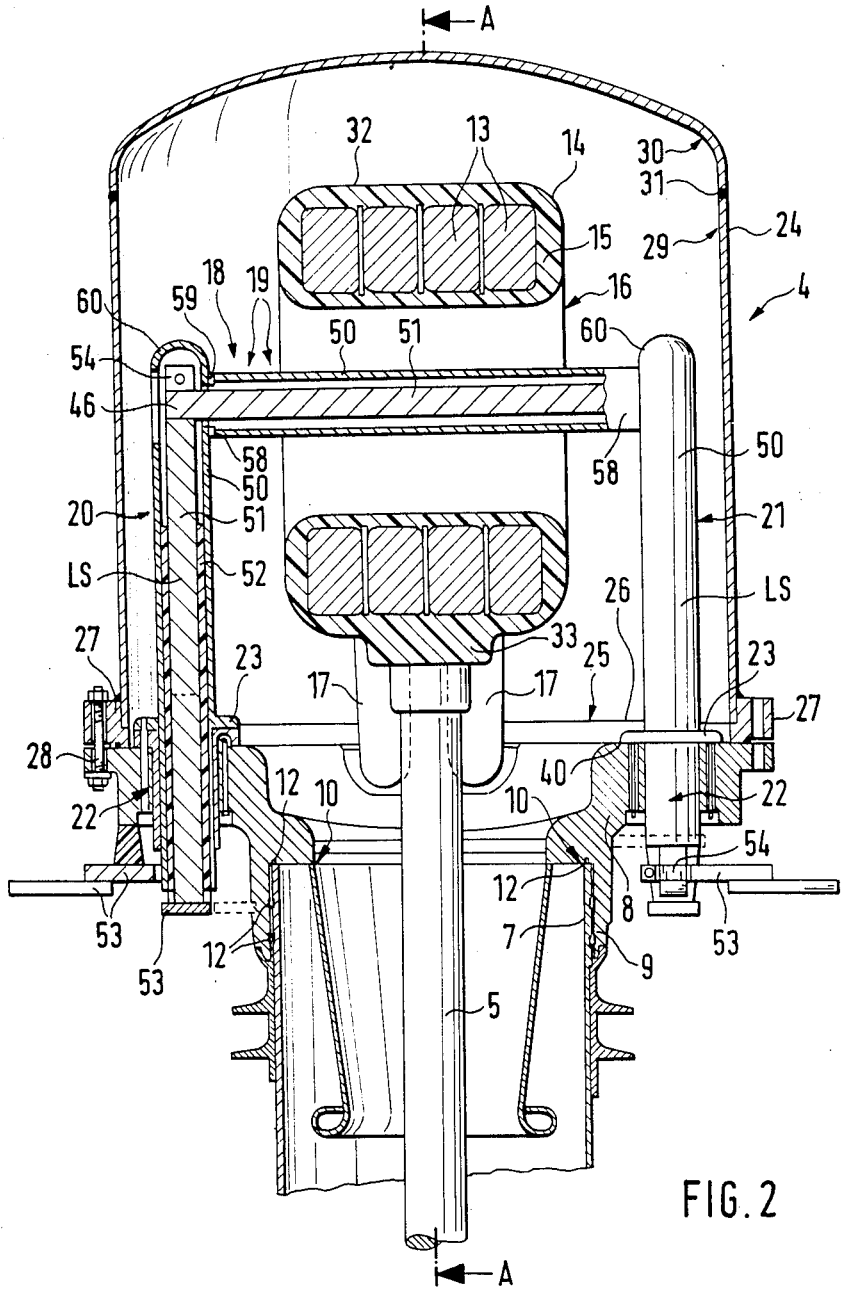
FIG. 2 is an enlarged view of the head area of the high-voltage current transformer according to FIG. 1.

A sealing plate 8 is fastened to the upper end 7 of column 2 and is sealed tight with respect to the insulating medium, i.e. it is oil- or gas-tight. Preferably sealing plate 8 has a downwardly projecting collar 9 which fits around column 2 from the outside, as shown in FIG. 2. An inner support edge 10 abuts end 11 of column 2 with a gasket 12 between.

Figure 3:
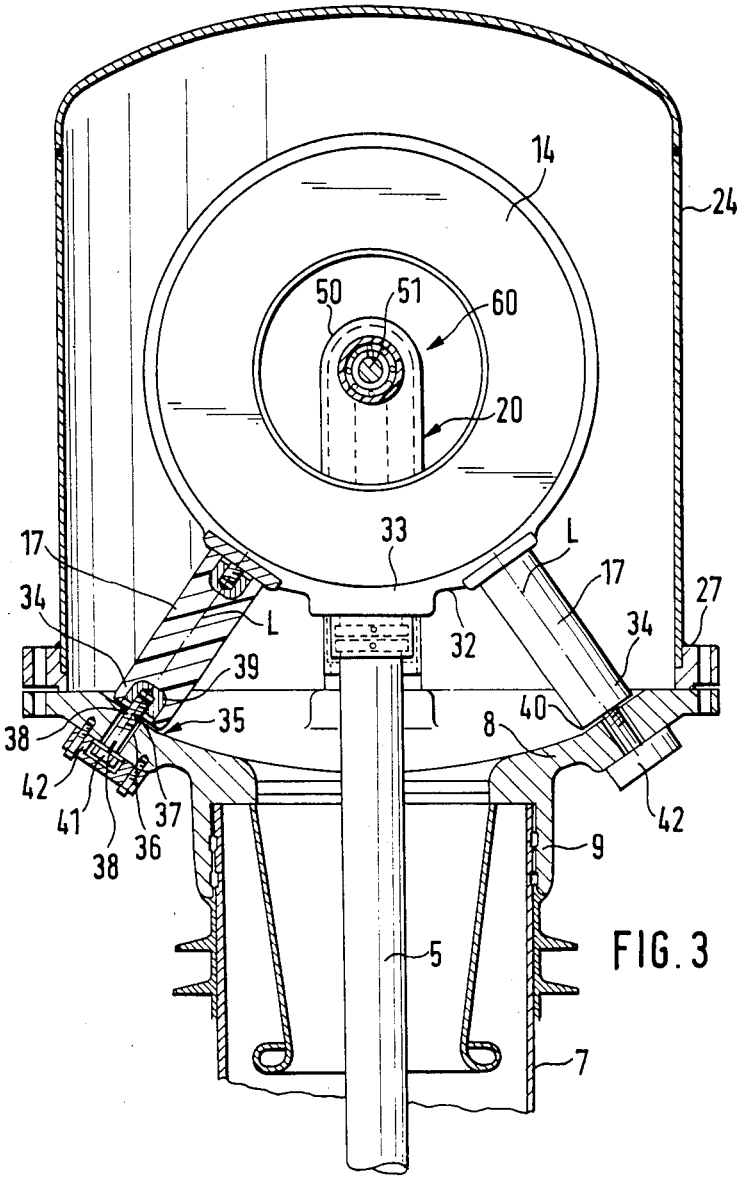
FIG. 3 is a view along Line A—A of FIG. 2.

Lead tube 5 fits into a secondary system 16 preferably composed of a plurality of annular cores 13 with corresponding secondary windings (not shown) and a cast resin shell 15 forming a ring 14. The secondary system is fastened exclusively by insulating supports 17 on sealing plate 8, as shown in FIG. 3. These supports 17 are advantageously disposed extending diagonally outward and are advantageously disposed centrally with respect to lead tube 5. In addition, primary lead 18 is fastened exclusively to sealing plate 8. Primary lead 18 is U-shaped or at least approximately U-shaped, having a base 19 which passes at least approximately centrally through ring 14 and core or cores 13 and two legs 20, 21 which are fastened by means of connecting segments 22 and pass through sealing plate 8 in an insulating-medium-tight manner. An outer flange 23 mounted on legs 20, 21 supports the legs on the sealing plate. Legs 20, 21 are contactable externally from beneath sealing plate 8.

Sealing plate 8 is designed to extend laterally on all sides beyond all the active parts, i.e. secondary system 16 and the entire primary lead 18. For example, it can have a tub or plate shape. A hood 24 designed as a head housing, is dished from above over the above-mentioned parts. A flange 27 is provided at edge 26 of hood opening 25. Fasteners through flange 27 and onto sealing plate 8 secure hood 24 to the sealing plate in an insulating-medium-tight manner. Hood 24 can consist of a tubular segment 29 and a hood-or pot-shaped lid 30, which are soldered or welded at junction or butt joint 31 in the metal design or are overlapped at contact point 31 for example in the fiberglass reinforced plastic design. Hood 24 can also consist of a single drawn molded or shaped part.

Secondary leads are brought out at a reinforced lead point 33 on ring 14 of secondary system 16 at its circumference 32. Lead tube 5 is introduced at point 33. Ring 14 is preferably metallized on the exterior, for example by spray galvanization. This metal coating is grounded as usual.

Figure 4:
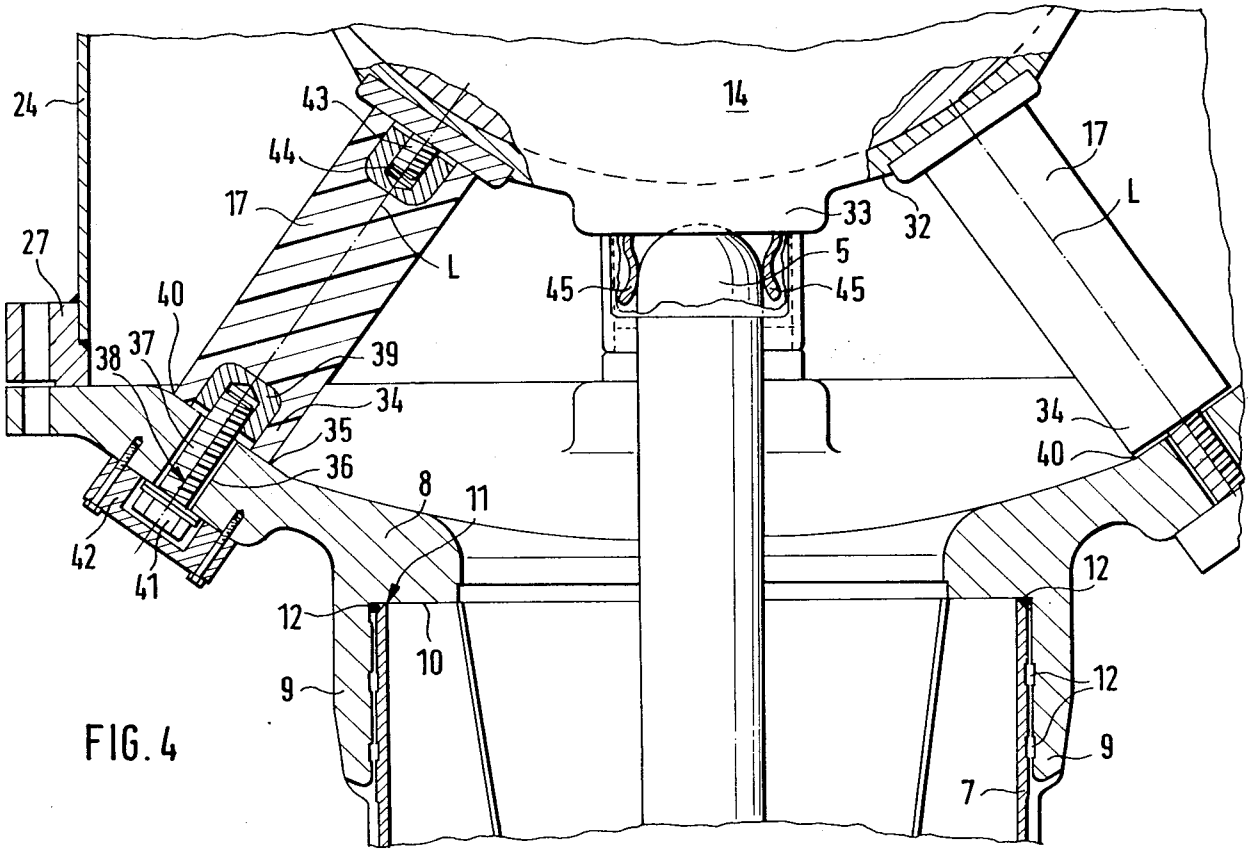
FIG. 4 is an enlarged section of the lower part of FIG. 3 in the vicinity of the sealing plate.

At least three supports 17 are provided. Supports 17 for ring 14 can be molded on ring 14 itself, i.e they can be cast in one piece from cast resin. However, they can also be molded with suitable projections or releasably connected to ring 14. The projecting free ends 34 of supports 17 rest on supporting surfaces 35 of sealing plate 8, which are disposed perpendicularly to longitudinal axis L of supports 17 as illustrated in FIG. 4. A bore 36 is provided in support surface 35 through which bore a screw shaft 37 of a mounting screw 38 passes and is screwed into a molded threaded bushing 39 in support 17. A gasket 40 is provided between supports 17 and sealing plate 8. If desired, to increase safety against the escape of compressed gas or insulating oil, a lid 42 can be mounted using screw head 41 or a suitable nut over screw 38. The lid 42 is connected tightly sealed to sealing plate 8, especially by screwing.

A threaded part 43 in the shape of a threaded bushing or threaded bolt is molded in cast resin shell 15 and supports 17 are screwable thereto by means of a reverse threaded part 44 molded therein.

In order to compensate for differences in longitudinal expansion of insulating column 2 on the one hand and lead tube 5 on the other hand as a result of temperature fluctuations during operation, and also to simplify the installation of secondary system 16 on lead tube 5, the connection between lead point 33 and lead tube 5 is mechanically designed as a longitudinal displaceable plug connection, preferably a plug contact connection. As illustrated in FIG. 4, the upper end of lead tube 5 is then coaxially surrounded and held under spring tension, in the manner of a sliding seat, by one or more contact springs 45, arranged in a ring around lead tube 5. Preferably, the contact springs 45 are a collar with a plurality of slots.

Figure 5:
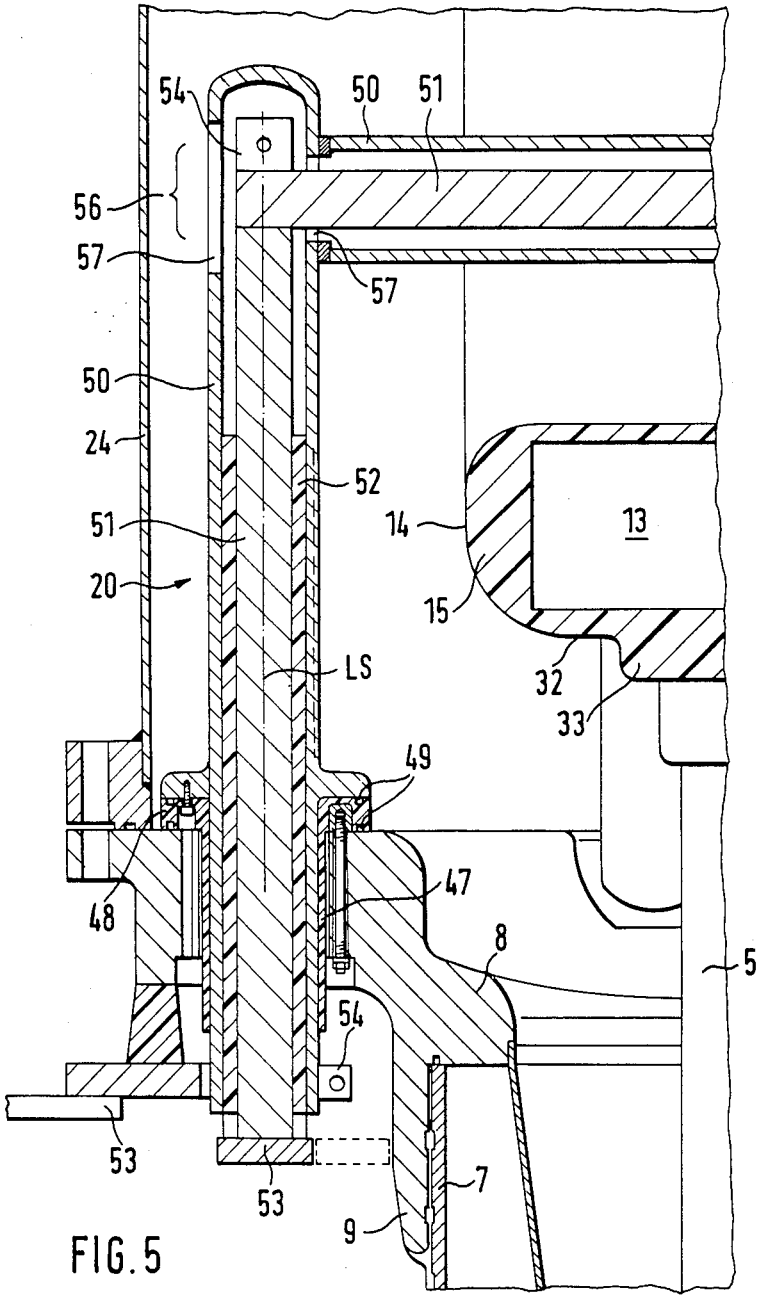
FIG. 5 is an enlarged view of a section of FIG. 2 with the left leg of the primary lead.

According to another advantageous embodiment of the invention, primary lead 18 can consist of two or more parts for example of an angle and a leg or a base and two legs. In the case of one angle, one angular leg forms base 19 to which legs 20 and 21 are attached. This design permits easy installation, especially with small core or ring inside diameters. In a three-piece design, legs 20, 21 are fastened at obtuse or right angles to the ends 46 of rod-shaped base 19, as shown in FIG. 2. Legs 20, 21 can be designed as bolts to receive the threaded ends of base 19. Leg or legs 20 and/or 21 are insulated from sealing plate 8 by an insulating bushing 47 and a ring shaped flange 48 extending from insulating bushing 47 as shown in FIG. 5. The insulating bushing 47 and flange 48 are sealed on sealing plate 8, for example by potting or by using O-ring seals or the like. Flange 48 is screwed tightly down on the one hand against outer flange 23 of leg 20, 21 and on the other hand against sealing plate 8 by separate screws. The screws extending from flange 48 and sealing plate 8 into the insulating ring 48 should not create electrical contact between flange 48 and sealing plate 8 bridging the insulating ring.

Figure 6:
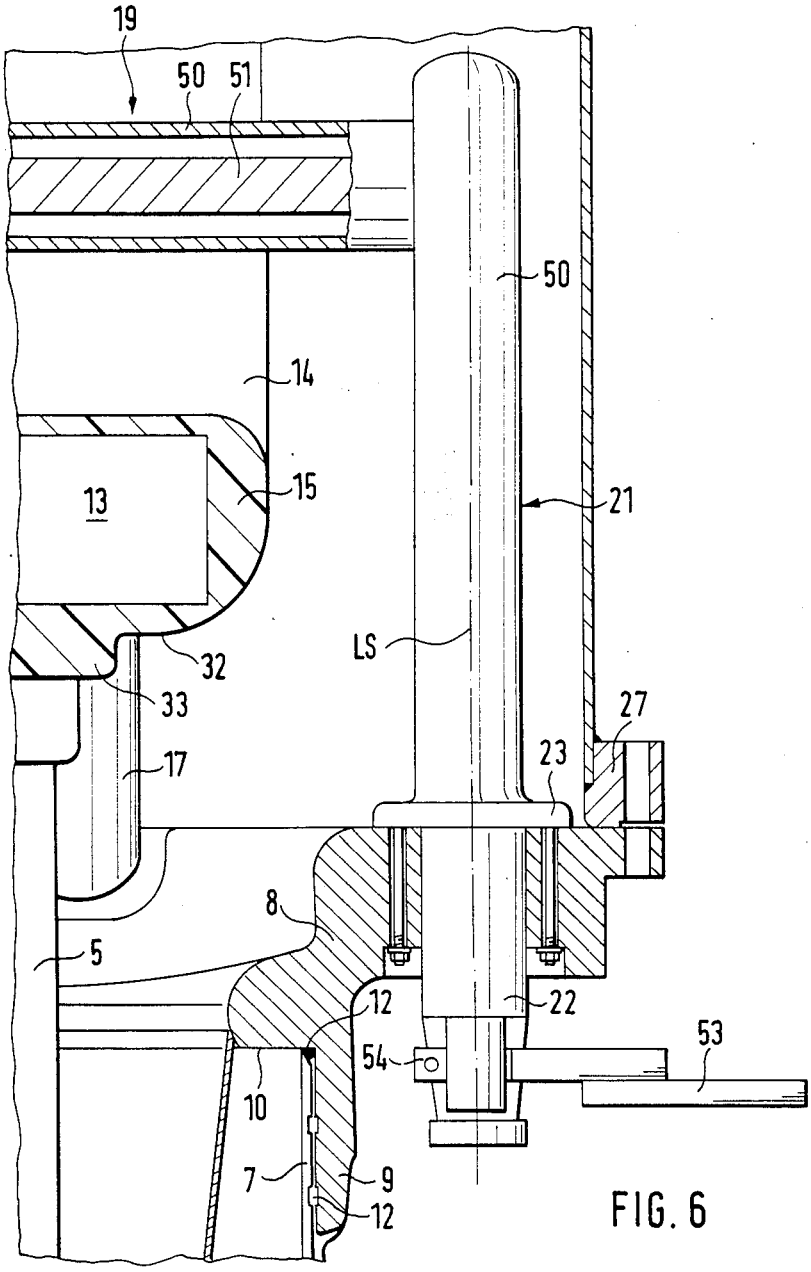
FIG. 6 is an enlarged view of a portion of FIG. 3 with the right leg of the primary lead.

Another advantageous embodiment of the invention consists in the fact that primary lead 18 is designed as a coaxial double lead in which two U-shaped leads insulated from one another are provided. Preferably, one is made of an external lead 50 and the other of an internal lead 51. These leads are separated from one another by suitable insulating distances which are formed at least in part by a solid dielectric 52 such as cast resin, and fixed in place. Dielectric 52 is provided at least in the area of connecting sections 22 and thus simultaneously provides a seal. Lead 50 of one leg 20 is insulated by the insulating bushing 47 from sealing plate 8, as illustrated in FIG. 5. Lead 50 of the other leg 21 is connected in a conducting fashion with sealing plate 8, for example fastened directly thereto without insulation, as illustrated in FIG. 6. Of course, leads 50 of both legs 20, 21 have an outer flange 23. Inside leads 51 of legs 20, 21 are brought out insulated and terminals 53 can be attached to them in a suitably pivotable fashion, for example by means of a clamp 54 as illustrated in FIG. 6. The same thing can be provided on insulated outer lead 50 of leg 20 as illustrated in FIG. 5.

This design of primary lead 18 as a double lead makes it possible to use the two leads separately or to connect them in series or parallel. Therefore, it is possible to reverse them in a 1:2 ratio or in a parallel circuit the primary lead can be used for a higher current load. As individual leads, each of the two coaxial leads can also carry a separate measuring current.

The parallel connection is created by connecting together inner lead 50 and outer lead 51 at the ends of leg 20 and leg 21.

Series connection between contact leads 53 is provided by applying lead contact 53 to right outer lead 50 of left leg 20, by electrically connecting outer flange 23 of leg 21 with electrically conducting sealing plate 8, by further electrically connecting sealing plate 8 through an additional contact 53 (shown dashed in FIG. 2) with inner lead 51 of left leg 20 and by applying lead contact 53 to inner lead 51 of right leg 21.

To connect base 19 of primary lead 18 with legs 20, 21, clamps 54 are used. The latter can be made of the tubular or solid material of legs 20, 21 or of base 19, both with outer leads 50 and inner leads 51. This can be accomplished by suitable shaping and/or machining. As illustrated, the ends of leads 51 of legs 20 and 21 are shaped to include the clamps 54 of leads 51 of base 19. The ends 55 can be reduced in diameter to be received in clamps 54 as illustrated in FIG. 7.

For ease of assembly, outer lead 50 of legs 20, 21 has a hole 57 in area 56 of inner lead 51 of base 19, as shown in FIG. 5.

Figure 7:
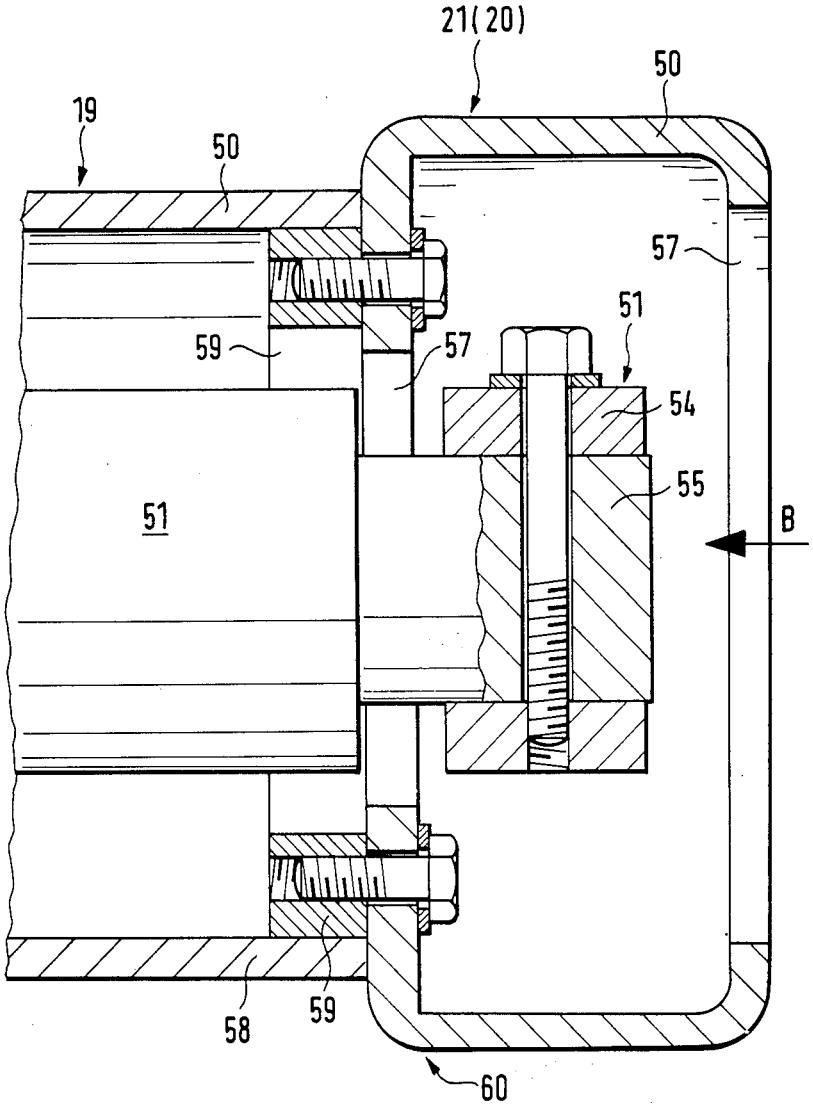
FIG. 7 is an enlarged view of the connection between the base and the leg of the primary lead from above.
Figure 8:
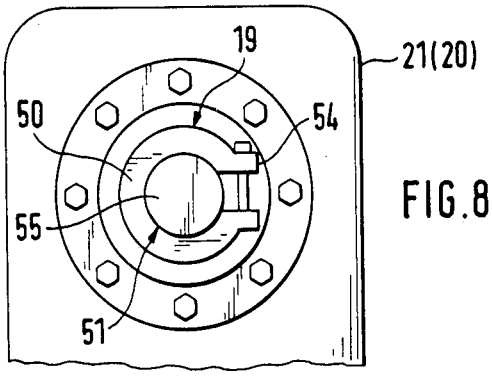
FIG. 8 is a view in the direction of Arrow B in FIG. 7.

The connection of outer lead 50 from base 19 to legs 20, 21 is by fasteners connecting a flange 59 mounted at each end 58 of outer leads 50 of base 19 to ends 60 of outer lead 50 of legs 20, 21 as illustrated in FIG. 7.

Figure 9:
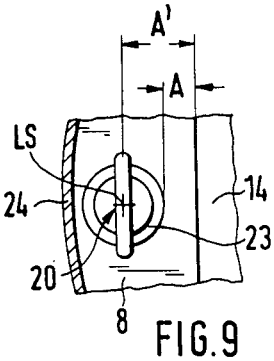
FIGS. 9–11 are views of one leg of the primary lead with a staggered inner segment.
Figure 10A:
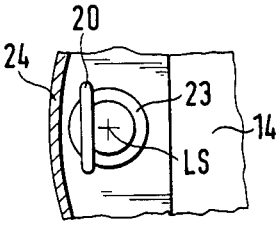
Figure 11:
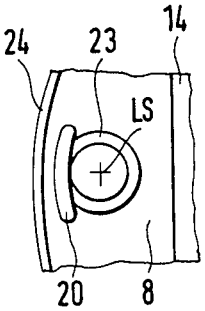
Figure 10B:
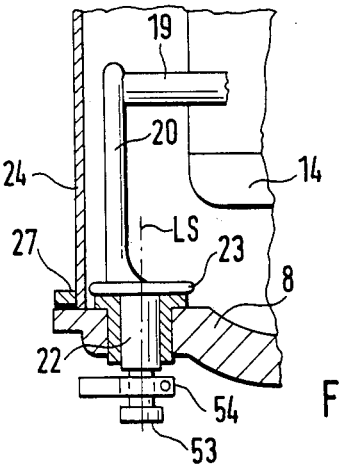

In order to produce a compact design of the high-voltage current transformer according to the invention, the portion of the leg of primary lead 18 which projects upward from outer flange 23 of legs 20, 21 into head housing 24 can be flattened as illustrated in FIG. 9, and/or off-set outwardly relative to the longitudinal axis LS of outer flange 23 or connecting section 22 as illustrated in FIG. 10. In addition, the flat leg section of legs 20, 21 can match the shape of hood 24, i.e. is convex as illustrated in FIG. 11.

As a result, a greater distance A', as illustrated in FIG. 9, is produced between the leg section 20, 21 and ring 14. Thus, the converter is either suitable for higher voltages or the distance and hence the diameter of hood 24 and head part 4 can be correspondingly reduced.

Figure 12:
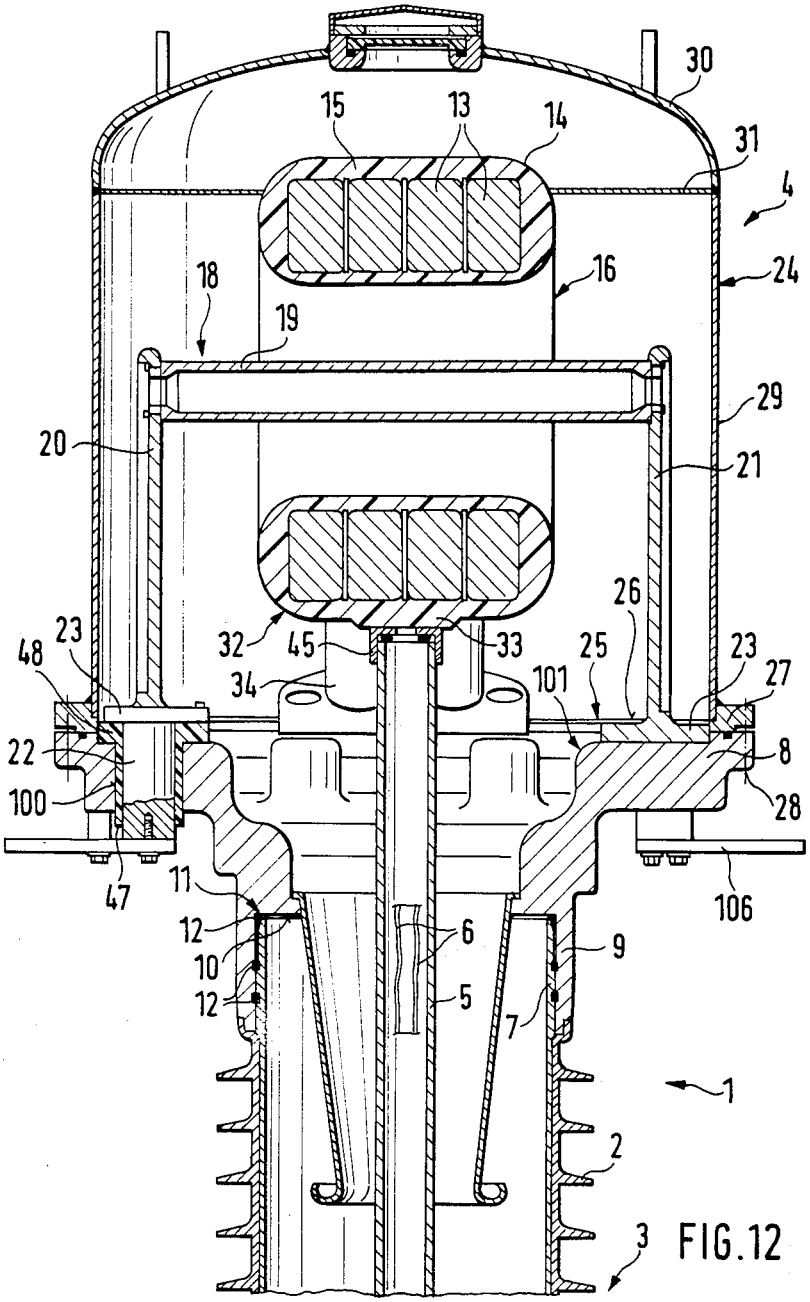
FIG. 12 is a cross-sectional view of a variation on the high-voltage head current transformer according to FIG. 1, with a non-switchable primary lead.

FIG. 12 shows a variation of the high-voltage head current transformer according to FIG. 2 for a non-switchable or single primary lead 18. The same parts have the same reference numbers as in FIGS. 1 and 2.

In this embodiment, primary lead 18 is again made U-shaped or at least approximately U-shaped. Its base 19 passes at least approximately centrally through ring 14 and/or core or cores 13 in addition to the secondary windings. One leg 20, by means of a connecting section 22, is passed through hole 100 in sealing plate 8 in an insulating-medium-tight fashion and is fastened in hole 100. An outer flange 23 mounted on leg 20 serves as a support. This leg 20 is electrically contactable directly from the outside, i.e. from beneath sealing plate 8. Connecting section 22 is fastened by an insulating bushing 47 and integral insulating flange 48 in an insulation-medium-tight and insulated fashion. The other leg 21 is mounted from the inside by fastener through outer flange 23 to the inside 101 of sealing plate 8. No holes going all the way to the outside are provided for the other leg, so that no seal is required. The electrical connection to leg 21 is made indirectly thereto by an externally mounted connection 106 to conductive sealing plate 8. Thus, the entire head is at the potential of primary lead 18 at this point. Therefore we have a non-switchable primary lead 18.

Sealing plate 8 is designed to project laterally on all sides beyond all active parts, i.e. secondary system 16 and primary lead 18, and separates them from the external leads. For example, it has the shape of a tub or plate. A hood 24, in the form of a head housing is dished over these above-mentioned parts. At the edge 26 of hood opening 25, a flange 27 is provided by which hood 24 can be tightly screwed onto sealing plate 8 using screw connections 28. Hood 24 can consist of a tubular segment 29 and a hood or pot-shaped lid 30, which, in the metal form, are soldered, welded or screwed to contact point 31, for example flanged, and in the fiberglass reinforced plastic design are overlapped at junction 31. Hood 24 can consist of a single drawn, molded, or shaped part.

At least two, preferably however three, supports 17 are provided. Supports 17 for ring 14 can be shaped together with ring 14, in other words cast in one piece out of cast resin. However, they can also be molded with suitable projections or can be releasably connected to ring 14.

The arrangement of a single support 17 on ring 14 can be a threaded part 43 in the shape of a threaded bushing or threaded bolt formed in cast resin shell 15 and supports 17 are screwable thereto by means of a counterthreaded part 44 molded therein.

In order to compensate for any possible difference in longitudinal expansion of insulating columns 2 and lead tube 5 as a result of temperature changes and also to simplify the mounting of secondary system 16 on lead tube 5, the connection between lead point 33 and lead tube 5 is in turn made mechanically as a longitudinally displaceable plug-in connection.

Figure 13:
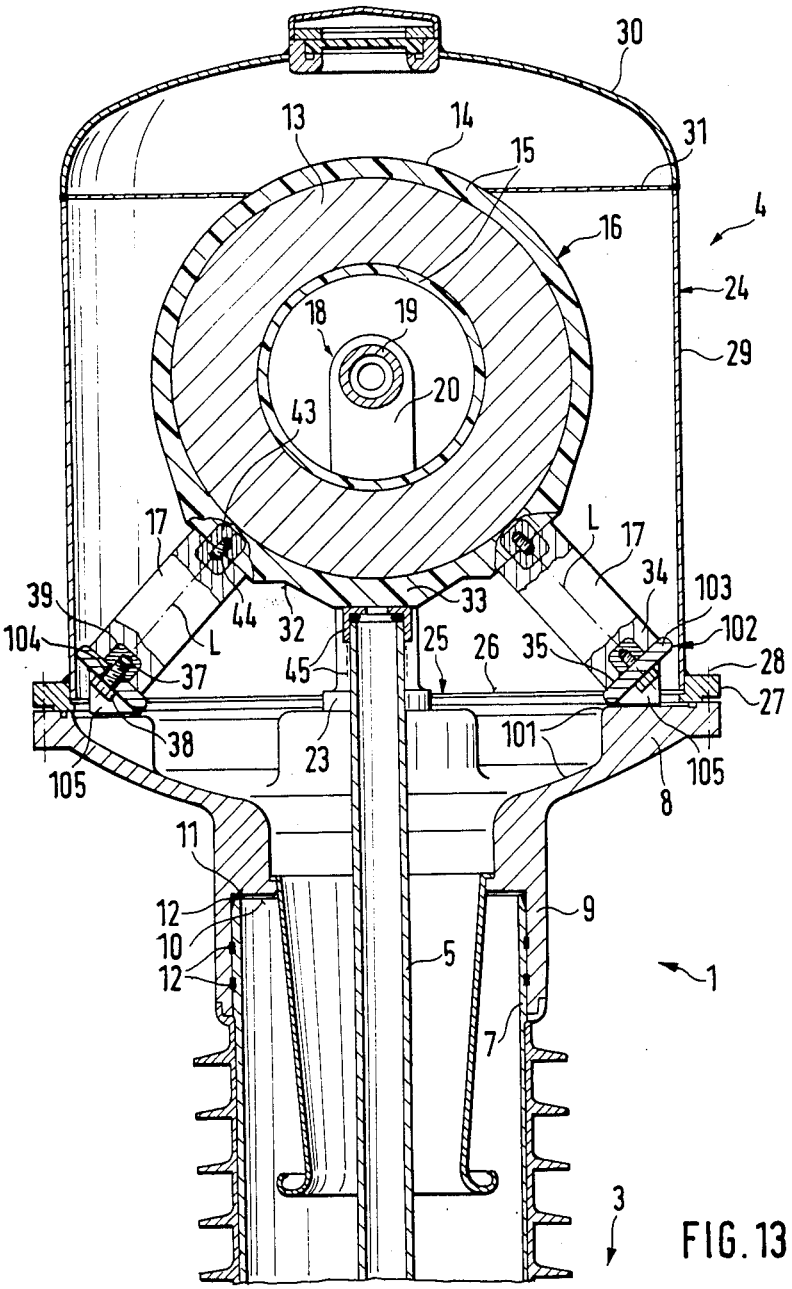
FIG. 13 is a cross-sectional view of a variation on the high-voltage head current transformer according to FIG. 1, with respect to the mounting of Support 17.

Counterbearings 102, illustrated in FIG. 13, are molded or fastened, especially screwed, in sealing plate 8 on the inside 101. Counterbearings 102 advantageously have one support plate 103 for each of supports 17. The support surface 35 of support plate 103 preferably being disposed perpendicular to longitudinal axis L of corresponding support 17. Support plates 103 are provided with a bore 104 through which a screw shaft 37 of a mounting screw 38 can be inserted from below and received in a threaded bushing 39 of support 17 is screwed. Support plates 103 can be one leg of an angle bar whose other leg is fastened to sealing plate 8, for example by screwing from inside. Advantageously a support plate 103 is provided on each side of a prism 105 and prism 105 is formed integral to sealing plate 8 or fastened thereto.

By using this type of support fastening within the space of hood 24, the need is eliminated to provide additional holes in sealing plate 8 which would make it necessary to seal it insulating-medium-tight as previously discussed for FIGS. 3 and 4.

The high-voltage head current transformer according to the invention is installed by first mounting ring 14 of secondary system 16 to sealing plate 8, by fasteners into supports 17. Then primary lead 18 is pushed as a homogeneous component or as a preassembled unit through ring 14 so that base 19 of primary lead 18 passes parallel through ring 14. The legs 20, 21 are then tightly fastened in sealing plate 8. However, it is also possible to fasten legs 20, 21 to sealing plate 8 first and then connect base 19 of primary lead 18 with inner ends 60 of legs 20, 21. Then hood 24 is positioned over the assembly and screwed tightly to sealing plate 8. This preassembled unit forming head part 4 is placed on column 2 and fastened insulating-medium-tight by means of seals 12 to the flange. Fastening is accomplished in a well known manner, for example by screwing, potting, or the like.

During installation, secondary leads are introduced into secondary lead tube 5. At the same time, plug-in contact connection 5, 45 is produced according to FIG. 4. It is also possible for hood 24 to be mounted later on. In each case, however, assurance must be provided that outlet tube 5 remains displaceable to a sufficient extent relative to ring 14 to avoid any mechanical stresses or strains on outlet tube 5 caused by the active system of the high-voltage current transformer according to the invention.

Basically, for reasons related to optimum dimensions for the head housing, the primary lead is made as a U-shaped lead with a horizontal base 19 and two legs 20, 21 perpendicular thereto. This however does not exclude the possibility of the angle between base 19 and legs 20, 21 being more than 90°, i.e. an obtuse angle of more than 90°.

Even if the primary lead 18, especially in the switchable version, preferably consists of a plurality of parts, advantageously of two to three parts, it is also possible to make the primary lead in one piece and, by suitably twisting, the open piece primary lead can be threaded through the center opening of secondary system 16 and connected electrically and/or mechanically with sealing plate 8 in suitable fashion. It is also basically possible to mount two such one-piece primary leads in series, insulated from one another, on sealing plate 8, and to provide suitable terminals for the required switching.

The important advantages of the high-voltage head current transformer according to the invention is that the head housing and hood 24 can be made with material savings and with a small expenditure of labor; that only one flange connection with sealing plate 8 is provided; that head housing 24 and lead tube 5 for the secondary leads are completely relieved of weight with respect of the weight of active system 13, 14, 18 of the high-voltage head current transformer; that in addition to the insulating medium used, such as gas or oil, no additional, especially no mixed solid/gas and solid/oil dielectrics are required, and that a compact, slender and weight-saving design for head housing 24 is possible, so that the top-heaviness of such high-voltage converters by comparison with known arrangements is considerably reduced.

For modified technical requirements, a short term replacement of secondary system 16 is basically possible.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed:

1. Method for manufacturing a high-voltage current transformer comprising:

mounting a secondary system, which comprises at least one annular core with a secondary winding, on a sealing plate;

positioning a U-shaped primary lead through said annular core with the base of the primary lead running at least approximately parallel to the axis of said core and mounting at least one of the legs of said primary lead extending through an opening in the sealing plate and connecting it seal tight as well as permanently with the sealing plate, whereby the base of the primary lead comes to rest centrally with respect to said core;

mounting said sealing plate with assembled secondary system and primary lead sealed tight on an insulating column with secondary leads connected in a plug-in manner to a lead tube in the column; and, securing a hood over said secondary system and primary lead to said sealing plate in a seal tight and permanent fashion.

* * * * *